United States Patent [19]

Miyakawa et al.

[11] 4,362,803

[45] Dec. 7, 1982

[54] ONE-COMPONENT TYPE MAGNETIC DEVELOPER FOR DEVELOPMENT AND TRANSFER OF POSITIVELY CHARGED IMAGES

[75] Inventors: Nobuhiro Miyakawa, Suita; Takashi Teshima, Amagasaki, both of Japan

[73] Assignee: Mita Industrial Co., Ltd., Osaka, Japan

[21] Appl. No.: 223,264

[22] Filed: Jan. 8, 1981

[30] Foreign Application Priority Data

Jan. 16, 1980 [JP] Japan ..... 55-2606

[51] Int. Cl.[3] ..... G03G 13/09

[52] U.S. Cl. ..... 430/122; 430/106.6

[58] Field of Search ..... 430/110, 122, 106.6

[56] References Cited

U.S. PATENT DOCUMENTS

| | | | |
|---|---|---|---|
| 3,165,420 | 1/1965 | Tomanek et al. | 430/106 X |
| 3,556,998 | 1/1971 | Steiner | 430/106 |
| 3,781,208 | 12/1973 | Ueda et al. | 430/106 |

FOREIGN PATENT DOCUMENTS

| | | | |
|---|---|---|---|
| 2538112 | 3/1976 | Fed. Rep. of Germany | 430/106 |

*Primary Examiner*—John D. Welsh

*Attorney, Agent, or Firm*—Sherman & Shalloway

[57] ABSTRACT

Disclosed is a one-component type magnetic developer for development of positively charged images and transfer of developed images, which comprises particles of a composition comprising a finely divided magnetic material dispersed in a binder medium comprising a vinyl aromatic polymer or acrylic polymer in an amount of 45 to 95% by weight based on the magnetic material, said particles of the magnetic material having a bulk density of at least 0.42 g/ml, a number average maximum size of 0.35 μm as measured by an electron microscope and a maximum size/minimum size ratio of from 1.0 to 5.5, especially from 1.0 to 3, wherein said composition further comprises an aliphatic carboxylic acid having a total carbon number (inclusive of the carbon atom of the carboxyl group) of at least 14 per carboxyl group in an amount of 0.2 to 4% by weight and a negative charge controlling agent consisting of an alcohol-soluble metal-containing dye in an amount of 0.5 to 5% by weight based on said polymer.

This magnetic developer provides an excellent transferred image having high image density and image sharpness on a plain paper as a transfer sheet without fogging or broadening of the contour of the image. This image is excellent in reproducibility of fine lines, solid black portions and half tones.

4 Claims, No Drawings

ONE-COMPONENT TYPE MAGNETIC DEVELOPER FOR DEVELOPMENT AND TRANSFER OF POSITIVELY CHARGED IMAGES

BACKGROUND OF THE INVENTION (1) Field of the Invention

The present invention relates to a one-component dry magnetic developer suitable for obtaining a copied image or printed image by developing a positively charged image on a photosensitive plate and transferring the developed image on a plain paper as a transfer sheet.

(2) Description of the Prior Art

A so-called one-component magnetic developer comprising a finely divided magnetic material dispersed in developer particles is known and widely used as the developer capable of developing an electrostatic latent image without using a particular carrier.

As one type of the one-component magnetic developer, there is known a so-called conductive magnetic developer in which a finely divided magnetic material is incorporated in developer particles to impart a magnetically attractable property and a conducting agent such as conductive carbon black on the surfaces of the particles to impart an electric conductivity (see, for example, the specifications of U.S. Pat. Nos. 3,639,245 and 3,965,022). When this conductive magnetic developer is brought into contact in the form of a so-called magnetic brush with an electrostatic latent image-supporting plate to effect development of the latent image, there can be obtained an excellent visbile image free of so-called edge effects or fogging. However, it is known that a serious problem arises when this developer image is transferred from the plate to an ordinary transfer sheet. More specifically, as disclosed in Japanese Patent Application Laid-Open Specification No. 117435/75, when the inherent electric resistance of a transfer sheet is lower than $10^3$ Ω-cm as in case of a plain paper, at the transfer step, broadening of the contour or reduction of the transfer efficiency is caused by scattering of developer particles. This disadvantage is removed to some extent if the toner-receiving surface of a transfer sheet is coated with a resin, wax or oil having a high electric resistance, but this improving effect is reduced under a high humidity condition. Furthermore, the cost of transfer sheets is increased by coating with a resin or the like and the touch or feel is reduced by the presence of such coating.

As another type of the one-component magnetic developer, there is known a one-component non-conductive magnetic developer comprising an intimate and homogeneous mixture of a finely divided magnetic material and an electricity-detecting binder. For example, the specification of U.S. Pat. No. 3,645,770 discloses an electrostatic photographic reproduction process in which a magnetic brush (layer) of the above-mentioned one-component non-conductive magnetic developer is charged by corona discharge with a polarity opposite to the polarity of an electrostatic latent image to be developed, the charged developer is brought into contact with an electrostatic latent image-supporting plate to develop the latent image and the developer image is transferred onto a transfer sheet. This electrostatic photographic reproduction process is advantageous in that a transfer image can be formed even on a plain paper as a transfer sheet. However, it is difficult to uniformly charge the magnetic brush of the non-conductive magnetic developer entirely even to the deep root portion, and therefore, it is difficult to obtain an image having a sufficiently high concentration. Furthermore, since a corona discharge mechanism should be disposed in the zone of a developing device, the copying apparatus becomes complicated.

Recently, there have been proposed a process in which development of an electrostatic latent image is accomplished by utilizing charging of a non-conductive magnetic developer by frictional contact of the developer with the surface of an electrostatic latent image-supporting plate (see Japanese Patent Application Laid-Open Specification No. 62638/75) and a process in which development is accomplished by utilizing dielectric polarization of a non-conductive magnetic developer (Japanese Patent Application Laid-Open Specification No. 133026/76).

In the former process, however, developing conditions should be controlled strictly, and if the developing conditions are not strictly controlled, fogging in a non-image area (especially conspicuous when the degree of contact of the top end of a spike of magnetic toner particles with the surface of a photosensitive material is high) or fixation or blocking of magnetic toner particles on a developing sleeve is caused, and this defect is especially conspicuous when the copying operation is continuously conducted.

In the latter process, although a problem of fogging does not arise, since a visible image is formed by the developing charge produced by the dielectric polarizing effect induced in the magnetic toner to an electrostatic latent image, a low-potential portion of the latent image cannot effectively be developed. Accordingly, a low-density area of an original is not effectively reproduced in the obtained copy and reproduction of a half tone in the copy is very difficult.

Furthermore, copies obtained according to these two known processes are poor in the image sharpness, and when a p-type photosensitive material such as selenium is used for a photosensitive plate and a positively charged image is developed, it is difficult to obtain images having a sufficiently high density according to any of these two known processes.

BRIEF SUMMARY OF THE INVENTION

We found that if a finely divided magnetic material having specific bulk density and particle size characteristic is selected and used as the magnetic material of the one-component magnetic developer and developer particles are prepared by dispersing this specific magnetic material into a binder medium comprising a vinyl aromatic polymer or an acrylic polymer and adding a higher fatty acid or its metal salt and an alcohol-soluble metal dye to the dispersion, development of a positively charged image on a photosensitive plate and transfer of the developed image on a plain paper can be performed at a high developing efficiency and a high transfer efficiency and a transfer image being excellent in reproducibility of fine lines, solid black portion and half tones and having a high density can be obtained.

It is therefore a primary object of the present invention to provide a highly electrically resistant, one-component magnetic developer which makes it possible to perform development of a positively charged image on a photosensitive plate and subsequent transfer of the developed image on a plain paper at high developing and transfer efficiencies without contamination of the background or broadening of the contour in the transferred image.

Another object of the present invention is to provide a highly electrically resistant, one-component dry magnetic developer which makes it possible to perform development of an electrostatic charged image very easily without using a particular accessory device such as a corona discharge mechanism or excessive frictional contact of a magnetic brush of the developer with the surface of a photosensitive plate.

Still another object of the present invention is to provide a highly electrically resistant, one-component type dry developer which can provide a transfer image excellent in reproducibility of fine lines, solid black portions and half tones and having a very high density.

In accordance with the present invention, there is provided a one-component type magnetic developer for development of positively charged images and transfer of developed images, which comprises particles of a composition comprising a finely divided magnetic material dispersed in a binder medium comprising a vinyl aromatic polymer or acrylic polymer in an amount of 45 to 95% by weight based on the magnetic material, said particles of the magnetic material having a bulk density of at least 0.42 g/ml, a number average maximum size of 0.35 μm as measured by an electron microscope and a maximum size/minimum size ratio of from 1.0 to 5.5, especially from 1.0 to 3, wherein said composition further comprises an aliphatic carboxylic acid having a total carbon number (inclusive of the carbon atom of the carboxyl group) of at least 14 per carboxyl group in an amount of 0.2 to 4% by weight and a negative charge controlling agent consisting of an alcohol-soluble metal-containing dye in an amount of 0.5 to 4.8% by weight based on said polymer.

The present invention will now be described in detail.

DETAILED DESCRIPTION OF THE PREFERRED EMBODIMENTS

When a magnetic brush of a one-component type developer is brought into contact with an electrostatic latent image-supporting surface of a substrate, an electrostatic attracting force (Coulomb force) and a magnetic attracting force are produced between the developer particles and the electrostatic latent image and between the developer particles and a magnetic brush-forming magnet, respectively. Accordingly, developer particles on which the Coulomb force is larger are attracted to the electrostatic latent image and developer particles on which the magnetic attracting force is larger are attracted to a developing sleeve, whereby development is conducted according to the electrostatic latent image on the substrate. Accordingly, it is required that a certain balance should be maintained between the magnetic characteristic and charging characteristic at the developing step.

When a developer image is transferred onto a transfer sheet, corona discharge of a polarity opposite to the retained charges of the developer, that is, the same polarity as that of the electrostatic latent image on the photosensitive substrate (positive polarity), is performed from the back surface of the transfer sheet, whereby the developer image is attracted toward the transfer sheet. When the retained charges on the developer particles are readily extinguished or neutralized, the developer particles are scattered around or repelled toward the photosensitive plate, resulting in occurrence of broadening of the contour of the transferred image or reduction of the transfer efficiency. Accordingly, although this one-component magnetic developer contains a relatively large quantity of the finely divided magnetic material, it is required that the developer should have a property of retaining charges stably.

One of important features of the developer of the present invention is that a finely divided magnetic material having a bulk density of at least 0.42 g/ml (in the instant specification and appended claims, the bulk density is one determined according to the method of JIS K-5101), a number average maximum size of at least 0.35 μm as measured by an electron microscope (sometimes referred to merely as "particle size") and a shape anisotropy of 1.0 to 5.5 defined as the maximum size/minimum size ratio is selected as the magnetic material and a magnetic developer is prepared by combining this magnetic material with specific binder medium, fatty acid or its metal salt and metal-containing dye described hereinafter.

The finely divided magnetic material that is used in the present invention, especially triiron tetroxide (magnetite), has a higher bulk density than that of triiron tetroxide customarily used in this field and it has a larger particle size and a smaller shape anisotropy. More specifically, triiron tetroxide customarily used for one-component type magnetic developers have ordinarily a number average particle size of 0.1 to 0.3 μm and a bulk density of about 0.3 to 0.4 g/ml. Furthermore, in so-called needle triiron tetroxide, the shape anisotropy, that is, the maximum size/minimum size ratio, is at least 6. When a finely divided magnetic material having a bulk density of at least 0.42 g/ml, a particle size of at least 0.35 μm and a shape anisotropy of from 1.0 to 5.5 is selected and used according to the present invention, as shown in Table 3 appearing on Example 2, the image density is highly improved over the image density obtained by a comparative magnetic material not satisfying the above requirements, and also the sharpness of the image and reproducibility of half tones are highly improved and scattering of toner particles is prominently controlled.

The reasons why such effects are attained in the present invention have not completely been elucidated, but it is believed that these effects will probably be attained by virtue of the following features.

The magnetic material having properties specified in the present invention tends to provide a magnetic developer having a smaller electrostatic capacitance and a smaller dielectric constant than those of magnetic developers prepared by using conventional magnetic materials.

The developer of the present invention has a relatively small electrostatic capacitance of 6.5 to 8.5 PF (picofarad) and a relatively small dielectric constant of 3.33 to 4.36, each being determined under conditions of an electrode spacing of 0.65 mm, an electrode sectional area of 1.43 $cm^2$ and an interelectrode load of 105 $g/cm^2$.

As pointed out hereinbefore, in a magnetic developer, the developing efficiency is influenced by a balance between the magnetic attracting force and Coulomb force simultaneously imposed on the developer particles. When a magnetic material having properties specified in the present invention is used, since the dielectric constant is maintained at a relatively low level, charging of respective developer particles can be facilitated, and since the electrostatic capacitance is maintained at a relatively low level, the tendency of the applied charges to escape is controlled, with the result that the developing efficiency and transfer efficiency are increased.

In the present invention, it also is important that a finely divided magnetic material having the above-mentioned characteristics should be dispersed in a medium comprising an aliphatic carboxylic acid having at least 14 carbon atoms (inclusive of the carbon atom of the carboxyl group) per carboxyl group or a salt thereof and a vinyl aromatic polymer or acrylic polymer.

It also is important that an alcohol-soluble metal-containing dye should be incorporated into this binder medium comprising the vinyl aromatic polymer or acrylic polymer.

As illustrated in Example 1 given hereinafter, even if a magnetic material satisfying the requirements of the present invention is used, when it is dispersed in a medium free of the above-mentioned aliphatic carboxylic acid or its salt or the negative charge controlling agent consisting of the metal-containing dye, it is difficult to increase the density of the transferred image to a satisfactorily high level, and the obtained copy is poor in the sharpness and contamination of the background is caused by scattering of the toner.

This defect is similarly observed when an aliphatic dicarboxylic or monocarboxylic acid having less than 14 carbon atoms per carboxyl group or a dicarboxylic acid is employed as the carboxylic acid component (see Example 3) or when a metal-containing dye is used in an amount outside the range specified in the present invention or the binder medium is a polymer other than the polymer specified in the present invention, such as an epoxy resin or polyester resin (see Example 4).

In the present invention, it is important that a magnetic material having the above-mentioned characteristics should be combined with the vinyl aromatic polymer or acrylic polymer, the fatty acid or its metal salt and the alcohol-soluble metal-containing dye.

A magnetic material having the above-mentioned bulk density and particle size characteristics is easily available as a product having a relatively coarse particle size from cubic triiron tetroxide and slightly rounded amorphous triiron tetroxide. Triiron tetroxide of this type has a shape anisotropy in a preferred range of from 1.0 to 3.0. Furthermore, triiron tetroxide closer to a needle crystal can be used in the present invention so far as the particles have a short and thick shape and a shape anisotropy lower than 5.5.

Triiron trioxide having the above-mentioned characteristics may be prepared according to the following process, though the preparation process is not limited to the process described below. More specifically, an aqueous solution of sodium hydroxide is added to an aqueous solution of iron (III) sulfate to form a precipitate of iron (III) hydroxide. Then, the pH value of the mother liquor is adjusted to 4 to 10 and the hydrothermic treatment is carried out under pressure to convert a gel-like precipitate of iron hydroxide to cubic $\alpha$-$Fe_2O_3$ (hematite). Conditions for preparation of this cubic $\alpha$-diiron trioxide are described in detail, for example, in Nobuoka et al., Kogyo Kagaku Zasshi, 66, page 412 (1963). The hydrothermic treatment may be carried out at 150° to 230° C. for 10 to 100 hours. Ordinarily, as the pH value of the mother liquor is high, the particle size is large. Accordingly, $\alpha$-diiron trioxide having a desirable particle size can easily be obtained by adjusting the pH value of the mother liquor as well as the treatment temperature and time. The so-obtained $\alpha$-diiron trioxide is subjected to a reducing treatment under known conditions, for example, in a reducing furnace with hydrogen at 400° C., whereby triiron tetroxide of an isometric system or slightly rounded amorphous triiron tetroxide ($Fe_3O_4$) is obtained. The reducing treatment is ordinarily carried out so that the $Fe^{2+}/Fe^{3+}$ atomic ratio in the resulting triiron tetroxide is in the range of from 0.9/1.0 to 1.1 to 1.0, whereby triiron tetroxide having the above-mentioned characteristics can be obtained.

At the step of forming $\alpha$-diiron trioxide as the precursor, if the hydrothermic treatment is carried out under a relatively low pH value condition, there can be obtained triiron tetroxide in which corners of cubic crystals are rounded or amorphous triiron tetroxide having a slightly rounded shape is obtained.

It is preferred that triiron tetroxide that is used in the present invention should have a coercive force (Hc) lower than 400 Oe, especially lower than 300 Oe.

The binder that is used in the present invention should comprise at least one member selected from vinyl aromatic monomers and acrylic monomers. It may further comprise at least one of other monomers. That is, homopolymers and copolymers of vinyl aromatic monomers or acrylic monomers and polymer blends thereof can be used as the binder medium.

As the vinyl aromatic monomer, there are preferably used monomers represented by the following formula:

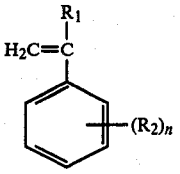

wherein $R_1$ stands for a hydrogen atom, a lower alkyl group having up to 4 carbon atoms or a halogen atom, $R_2$ stands for a substitutent such as a lower alkyl group or a halogen atom, and n is an integer of 0, 1 or 2, such as styrene, vinyltoluene, $\alpha$-methylstyrene, $\alpha$-chlorostyrene and vinylxylene, and vinylnaphthalenes. Among these monomers, styrene and vinyltoluene are especially preferred.

As the acrylic monomer that is used in the present invention, there can be mentioned, for example, monomers represented by the following formula:

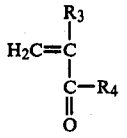

wherein $R_3$ stands for a hydrogen atom or a lower alkyl group, and $R_4$ stands for a hydroxyl group, an alkoxy group, a hydroxyalkoxy group, an aminoalkoxy group or an amino group, such as acrylic acid, methacrylic acid, ethyl acrylate, methyl methacrylate, butyl acrylate, butyl methacrylate, 2-ethylhexyl acrylate, 2-ethylhexyl methacrylate, 3-hydroxypropyl acrylate, 2-hydroxyethyl methacrylate, 3-aminopropyl acrylate, 3-N,N-diethylaminopropyl acrylate and acrylamide.

As the monomer to be used in combination with the above monomers, there can be mentioned conjugated diolefin monomers represented by the following formula:

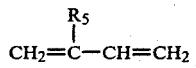

wherein $R_5$ stands for a hydrogen atom, a lower alkyl group or a chlorine atom, such as butadiene, isoprene and chloroprene, ethylenically unsaturated carboxylic acids and esters thereof such as maleic anhydride, fumaric acid, crotonic acid and itaconic acid, vinyl esters such as vinyl acetate, and vinylpyridine, vinylpyrrolidone, vinyl ethers, acrylonitrile, vinyl chloride, vinylidene chloride, ethylene and propylene.

It is preferred that the molecular weight of the polymer be 3,000 to 300,000, especially 5,000 to 200,000. The intended objects of the present invention can be attained if the content of the vinyl aromatic monomer in the polymer, copolymer or polymer blend is at least 20% by weight, especially at least 40% by weight.

In a preferred embodiment, a combination binder medium comprising a vinyl aromatic or acrylic polymer such as mentioned above and a hydrocarbon wax in an amount of 5 to 25% by weight, especially 8 to 20% by weight, based on the polymer is used. As the hydrocarbon wax, there can be mentioned, for example, low-molecular-weight polyethylene, low-molecular-weight polypropylene, an oxidized polyethylene wax, a paraffin wax and a microcrystalline wax. If this hydrocarbon wax is used, occurrence of the offset phenomenon is prevented at the step of fixing the developer image.

In the present invention, the binder medium is used in an amount of 60 to 125% by weight, especially 65 to 105% by weight, based on the magnetic material. If the amount of the binder is too small, the electric characteristics and fixing property of the developer tend to decrease, and if the amount of the binder is too large, the magnetic property becomes insufficient and fogging is readily caused to occur.

As the aliphatic carboxylic acid having at least 14 carbon atoms (inclusive of the carbon atom of the carboxyl group) per carboxyl group, there can be mentioned saturated fatty acids such as myristic acid, pentadecylic acid, palmitic acid, heptadecylic acid, stearic acid, nonadecanoic acid, arachic acid, behenic acid, lignoceric acid, cerotic acid, heptacosanoic acid and montanic acid, unsaturated fatty acids such as oleic acid, elaidic acid, linoleic linolenic acid, cetoleic acid, erucic acid, brassidic acid, arachidonic acid and stearolic acid, and polymerized fatty acids (dimer acids.). These acids may be used singly or in the form of a mixture of two or more of them. An aliphatic carboxylic acid having at least 18 carbon atoms (inclusive of the carbon atom of the carboxyl group) per carboxyl group is especially preferred. As preferred examples of the mixed fatty acid, there can be mentioned beef tallow fatty acid, coconut oil fatty acid and palm oil fatty acid.

As the metal salt of such fatty acid, there can be mentioned salts of alkaline earth metals such as calcium, magnesium and barium and polyvalent metals such as zinc, cadmium, aluminum, lead, cobalt, iron, nickel, chromium and manganese. In short, water-insoluble salts are preferred. Furthermore, lithium salts of such fatty acids can be used in the present invention.

In order to prevent blocking of the developer particles, it is preferred that the melting point of the aliphatic carboxylic acid or its metal salt be at least 45° C. Furthermore, in order to obtain a developer in which bleeding of the finely divided magnetic material from the binder medium is prevented and cohesion is effectively controlled during a long period storage, it is especially preferred that the fatty acid be used in the form of a metal soap.

In the present invention, the fatty acid or metal salt thereof is used in an amount of 0.2 to 4%, especially 0.3 to 3.5%, based on the finely divided magnetic material. When the amount of the fatty acid or its metal salt is too small and below the lower limit of the above range, the developing efficiency or transfer efficiency is reduced and the density of the image is readily lowered. When the amount of the fatty acid or its salt is too large and exceeds the upper limit of the above range, fogging is readily caused in the obtained copy and blocking is often caused in the developer.

As the alcohol-soluble metal-containing dye, there are used alcohol-soluble complex azo salts containing chromium, iron or cobalt. A 2:1 type metal complex salt dye represented by the following formula:

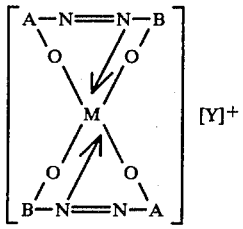

wherein A stands for a residue of a diazo component having a phenolic hydroxyl group at the ortho-position, B stands for a residue of a coupling component, M stands for chromium, iron or cobalt, and $[Y]^+$ stands for an inorganic or organic cation, is especially preferred. In addition, a sulfonylamine derivative of copper phthalocyanine can be used in order to attain the objects of the present invention.

Typical instances of metal-containing dyes that are effectively used for attaining the objects of the present invention are as follows.

Chromium-containing dye of C.I. Acid Black 123, C.I. Solvent Black 22, C.I. Solvent Black 23, C.I. Solvent Black 28, C.I. Solvent Black 42, C.I. Solvent Black 43, C.I. Solvent Red 8, C.I. Solvent Red 109, C.I. Solvent Yellow 80, C.I. Solvent Orange 37, C.I. Solvent Orange 45, C.I. Solvent Violet 21, C.I. Solvent Blue 25 and C.I. Solvent Black 37.

The negative charge controlling agent consisting of such metal-containing complex salt dye is used in an amount of 0.5 to 5% by weight, especially 0.75 to 4.5% by weight, based on the binder resin. If the amount of the dye is too small, it is difficult to sufficiently increase the density of the transferred image, and if the amount of the dye is too large, the fog density is increased but the image density is lowered.

Known adjuvants for developers may be added according to known recipes prior to kneading and pulverization in the present invention. For example, in order to improve the color tone of the developer, a pigment such as carbon black and a dye such as Nigrosine may be used singly or in combination in an amount of 0.5 to 5% by weight based on the total amount of the developer. Furthermore, in order to attain an extending effect, a filler such as calcium carbonate or finely divided silicic acid may be added in an amount of up to 20% by weight based on the total amount of the developer.

Moreover, in order to prevent cohesion or agglomeration of developer particles and improve the flowability of the developer, a flowability-improving agent such as finely divided polytetrafluoroethylene may be incorporated in an amount of 0.1 to 1.5% by weight based on the total amount of the developer.

Shaping of the developer is accomplished by cooling the above-mentioned kneaded composition, pulverizing the cooled composition and, if necessary, classifying the pulverization product. Of course, mechanical rapid stirring may be carried out so as to round corners of amorphous particles.

It is ordinarily preferred that the particle size of the developer particles be 5 to 35μ, though the preferred particle size is changed to some extent according to the desired resolving power. By the use of the developer of the present invention comprising amorphous particles thus prepared by kneading and pulverization, it becomes possible to remarkably increase the transfer efficiency and obtain a sharp image having a high density.

In the present invention, in order to improve the flowability of the developer, dry method finely divided silica may be sprinkled on the developer particles in an amount of 0.1 to 1% by weight based on the developer.

In the electrostatic photographic reproduction process using the developer of the present invention, formation of an electrostatic latent image is accomplished according to known procedures. For example, there may be adopted a method in which a photoconductive layer on an electrically conductive substrate is uniformly charged and is then subjected to imagewise exposure to form an electrostatic latent image.

A magnetic brush of the above-mentioned one-component magnetic developer is brought into contact with the surface of the substrate carrying the electrostatic latent image formed thereon, whereby a visible image of the developer is formed.

Then, the developer image on the substrate is brought into contact with a transfer sheet, and corona discharge is performed with the same polarity as that of the electrostatic latent image from the back surface of the transfer sheet to transfer the developer image onto the transfer sheet.

Fixation of the transferred image is accomplished according to an optional fixation method selected according to the kind of the developer, for example, heating roller fixation, flash lamp fixation or pressure roller fixation.

The developer of the present invention is especially suitable for developing a positively charged latent image formed on a p-type photosensitive plate such as a selenium photosensitive plate or an organic photoconductor photosensitive plate.

A conventional friction-charge type one-component magnetic developer can be used for developing a negatively charged latent image formed on a photosensitive plate, but only unsatisfactory results are obtained when this conventional developer is used for developing a positively charged latent image on a p-type photosensitive plate such as mentioned above. In contrast, the developer of the present invention provides excellent results at the development of such positively charged images and transfer of the developed images to transfer sheets.

The present invention will now be described in detail with reference to the following Examples that by no means limit the scope of the invention. Incidentally, in these Examples, all of "parts" are by weight.

EXAMPLE 1

By using a two-roll kneading device, magnetite having a coercive force of 213 Oe, a bulk density of 0.55 g/ml and a particle size of 0.4–0.5μ were kneaded with components shown in Table 1 under fusion, and the kneaded mixture was naturally cooled and roughly pulverized by a cutting mill to adjust the size to 0.5 to 2 mm. Then, the roughly pulverized mixture was finely pulverized by a jet mill and classified by a zigzag classifier to obtain a magnetic toner having a size of 5 to 25μ. Hydrophobic silica (R-972 supplied by Nihon Aerosil Co.) was added to the so obtained toner in an amount of 0.2% based on the toner to prepare a magnetic toner.

TABLE 1

| | Composition (parts by weight) | | | | |
|---|---|---|---|---|---|
| Recipe No. | Magnetite | Styrene/Acrylic Copolymer* | Low-Molecular-Weight Polypropylene** | Zinc Stearate | Negative Charge Controlling Agent*** |
| 1 | 55 | 41.5 | 3.5 | | 0.7 |
| 2 | 55 | 41.5 | 3.5 | 0.5 | |
| 3 | 55 | 41.5 | 3.5 | 0.5 | 0.7 |

Note
*weight average molecular weight = 71,000
**550-P supplied by Sanyo Chemical Industry Co.
***BONTRON S-31 supplied by Orient Chemical Industry Co.

Incidentally, the coercive force (Hc) was measured by a magnetic property-measuring device supplied by Toei Kogyo (Mode; VSMP-1; magnetic field=5K Oe), and the bulk density was determined according to the Method K-5101 of JIS and the average particle size was determined from an electron microscope photograph.

The copying test was carried out in the following manner by using the above three magnetic toners.

In a copying machine provided with a selenium drum (having an outer diameter of 150 mm) as a photosensitive material, the magnetic toner was applied to a developing roller of a so-called independent rotation system where a magnet and a sleeve were independently rotated. The intensity of the magnetic field on a developing sleeve (having an outer diameter of 33 mm) having a magnet installed therein through a non-magnetic material was adjusted to about 900 gauss, and the space between the sleeve and a spike-cutting plate was adjusted to 0.3 mm. A hopper was arranged so that the magnetic toner was supplied from the hopper to the zone of the developing roller, and the space between the developing roller and the surface of the photosensitive material was adjusted to 0.5 mm. The developing sleeve and photosensitive material were rotated in the same direction, and the magnet was rotated in the opposite direction. Under these conditions, charging (+6.7 KV), imagewise exposure, development, transfer (+6.3 KV), heating roller fixation and fur brush cleaning were carried out. Wood free paper having a thickness of 80μ was used as the transfer sheet. The results of the copying test and the properties of the magnetic toner are shown in Table 2. The image density was expressed as the density of the solid black portion of the image measured by a commercially available reflection densitomer (supplied by Konishiroku Shashin Kogyo). Scattering of the toner was evaluated from the copy and adhesion of the toner to contours of the image was checked. The electrostatic capacitance was determined by using a commercially available LC meter (supplied by Kokuyo Denki) and the electric resistance was measured by using a commercially available power source and ampere meter (supplied by Takeda-Riken). The cell used for determining the physical properties of the magnetic toners comprised an electrode portion comprised of stainless steel and an insulating portion comprised of quartz, in which the electrode spacing was 0.65 mm, the electrode sectional area was 1.43 $cm^2$ and the interelectrode load was 105 g/$cm^2$. The measurement was carried out at a temperature of 20° to 25° (room temperature) and a relative humidity of 55 to 65%.

From the results shown in Table 2, it will readily be understood that by incorporation of the negative charge controlling agent and zinc stearate, the image density was increased, and therefore, a copy having a sharp and clear image could be obtained. If magnetite of a needle crystal form (coercive force=370 Oe, bulk density=0.78 g/ml, particle length=0.5 to 0.7$\mu$, particle width=0.05 to 0.1$\mu$) was used in recipe No. 3, the image density was low and a sharp copy was not obtained.

TABLE 2

| Recipe No. | Volume Resistivity (Ω cm) | Electrostatic Capacitance (PF) | Dielectric Constant | Image Density | Scattering of Toner | Sharpness (image quality) |
|---|---|---|---|---|---|---|
| 1 | $1.6 \times 10^{14}$ | 8.0 | 4.10 | 0.62 | ○ | Δ |
| 2 | $2.1 \times 10^{14}$ | 7.7 | 3.95 | 1.10 | Δ | ○ |
| 3 | $2.2 \times 10^{14}$ | 7.7 | 3.95 | 1.48 | ◎ | ◎ |

EXAMPLE 2

Magnetic toners (a through l) were prepared according to recipe No. 3 of Example 1 by using 12 magnetites (a through l) having properties shown in Table 3. The copying test was carried out in the same manner as in Example 1. The obtained results are shown in Table 4. A commercially available test chart (DTATQUEST COPIER TEST PATTERN) was used for the copying test.

When the magnetite included in the scope of the present invention was used, a clear and sharp copy was obtained without scattering of the toner. Reproducibility of half tones in case of the developer of the present invention was such that 9 stages of 10 stages could clearly be recognized. However, in case of the magnetic toners comprising magnetites outside the scope of the present invention, scattering of the toner was observed, and the sharpness was poor or reproducibility of half tones was inferior.

In each magnetic toner, the volume resistivity was in the range of from $1.2\times10^{14}$ to $3.8\times10^{14}$ Ω-cm, and therefore, the values of the volume resistivity are not shown in Table 4.

The electrostatic capacitances of the magnetic toners were in the range of 7.0 to 8.2 PF, and the dielectric constants were in the range of 3.59 to 4.21. Magnetites having a smaller particle size were found to provide larger electrostatic capacitance and dielectric constant than magnetites having a larger particle size.

TABLE 3

| Magnetite | Physical Properties: Coercive Force (Oe) | Bulk Density (g/ml) | Particle Size ($\mu$) |
|---|---|---|---|
| a | 72 | 0.50 | 0.25 |
| b | 85 | 0.37 | 0.3–0.4 |
| c | 95 | 0.59 | 0.25 |
| d | 135 | 0.32 | 0.2–0.3 |
| e | 135 | 0.71 | 0.1–0.2 |
| f | 410 | 0.32 | 0.1–0.3 |

TABLE 3-continued

| Magnetite | Physical Properties: Coercive Force (Oe) | Bulk Density (g/ml) | Particle Size ($\mu$) |
|---|---|---|---|
| g (present invention) | 38 | 0.45 | 0.4–0.55 |
| h (present invention) | 41 | 0.53 | 0.5 |
| i (present invention) | 90 | 0.95 | 0.47 |
| j (present invention) | 114 | 0.45 | 0.35–0.4 |
| k (present invention) | 200 | 0.75 | 0.5 |
| l (present invention) | 215 | 0.65 | 0.45 |

TABLE 4

| Magentic Toner | Image Density | Scattering of Toner | Sharpness (image quality) | Reproducibility of Half Tones |
|---|---|---|---|---|
| a | 1.25 | ○ | Δ | ○ |
| b | 1.31 | ○ | ○ | ○ |
| c | 1.30 | Δ | ○ | ○ |
| d | 1.35 | Δ | ○ | ○ |
| e | 1.20 | Δ | ○ | Δ |
| f | 1.15 | Δ | Δ | Δ |
| g (present invention) | 1.58 | ◎ | ◎ | ◎ |
| h (present invention) | 1.60 | ◎ | ◎ | ◎ |
| i (present invention) | 1.58 | ◎ | ◎ | ◎ |
| j (present invention) | 1.55 | ◎ | ◎ | ◎ |
| k (present invention) | 1.56 | ◎ | ◎ | ◎ |
| l (present invention) | 1.54 | ◎ | ◎ | ◎ |

Note
Scattering of toner:
◎: not observed
○ : slightly observed
Δ: prominent
Sharpness:
◎: good
○ : fair
Δ: inferior
Reproducibility of half tones (10 stages):
◎: 9 stages
○ : 7 stages
Δ: 5 stages

EXAMPLE 3

By using a two-roll kneading device, 400 parts of the same magnetite j as used in Example 2, 360 parts of a vinyltoluene/butadiene copolymer (supplied by Goodyear Co. and having a weight average molecular weight of 78,000), 6 parts of a negative charge controlling agent (BONTRON S-31 supplied by Orient Chemical Industry Co.), 25 parts of a polyethylene wax, 5 parts of synthetic paraffin (having a melting point of 110° C.) and 4 parts of a long-chain carboxylic acid or its salt shown in Table 5 were kneaded under fusion, and the kneaded mixture was naturally cooled, roughly pulverized, finely pulverized and classified according to customary procedures. Then, hydrophobic silica was incorporated so as to improve the flowability.

The copying test was carried out in the same manner as described in Example 1. The obtained results are shown in Table 5.

From the results shown in Table 5, it is seen that the intended effects could not be obtained when lauric acid (total carbon number=12) or a dicarboxylic acid was used as the long-chain carboxylic acid, and that when a magnetic toner comprising a long-chain fatty acid having a total carbon number of at least 14 or its metal salt was used according to the present invention, a copy having a sharp image having a high density could be obtained without scattering of the toner.

When magnesium, lead, chromium, copper, iron and nickel salts of stearic acid were similarly used as the fatty acid metal salt, copies being excellent in the image quality and having a high image density could similarly be obtained.

In these magnetic toners, the volume resistivity was in the range of from $1.3\times10^{14}$ to $6.7\times10^{14}$ Ω-cm, the electrostatic capacitance was in the range of from 6.9 to 8.0 PF and the dielectric content was in the range of from 3.54 to 4.10.

TABLE 5

| Long-Chain Carboxylic Acid or Its Salt | Image Density | Scattering of Toner | Sharpness (image quality) |
|---|---|---|---|
| lauric acid ($C_{12}$) | 0.70 | ○ | Δ |
| myristic acid ($C_{14}$) | 1.30 | ◎ | ○ |
| palmitic acid ($C_{16}$) | 1.48 | ◎ | ◎ |
| stearic acid ($C_{18}$) | 1.52 | ◎ | ◎ |
| behenic acid ($C_{22}$) | 1.52 | ◎ | ◎ |
| lithium stearate | 1.53 | ◎ | ◎ |
| stannous stearate | 1.51 | ◎ | ◎ |
| aluminum monostearate | 1.58 | ◎ | ◎ |
| manganese oleate | 1.56 | ◎ | ◎ |
| cobalt linoleate | 1.50 | ◎ | ◎ |
| 1,10-decane-dicarboxylic acid | 0.90 | ○ | Δ |
| 1,18-octadecane-dicarboxylic acid | 1.23 | ◎ | ○ |

Note
Each parenthesized value indicates the total number of carbon atoms inclusive of the carbon atom of the carboxyl group.

EXAMPLE 4

A magnetic toner was prepared in the same manner as described in Example 1 by using 220 parts of magnetite having a coercive force of 70 Oe, a bulk density of 0.45 g/ml and a particle size of 0.3 to 1μ, 150 parts of a vinyltoluene/acrylic copolymer (supplied by Goodyear Co., molecular weight=63,000), 30 parts of low-molecular-weight polypropylene, 2.2 parts of aluminum distearate and 0, 1.2, 2.4, 3.6, 4.8 or 6.0%, based on the binder resin, of a negative charge controlling agent (Spilon Black TOH supplied by Hodogaya Chemical Industry Co.).

The copying test was carried out in the same manner as described in Example 1. The obtained results are shown in Table 6.

From the results shown in Table 6, it is seen that though the image density was enhanced with increase of the amount of the negative charge controlling agent, but if the amount of the negative charge controlling agent exceeded 6.0%, the image density was rather decreased and the fog density was increased.

A magnetic toner prepared in the same manner as described above by using an acrylic resin (X-106 supplied by Ionac Co.) or a styrene resin (D-125 supplied by Esso Standard Co.) provided a clear copy having an image density of 1.51 to 1.60 and a fog density of 0.11. However, a magnetic developer prepared by using an epoxy resin or polyester resin provided only a copy having an image density lower than 1.0. When 5000 copies were continuously prepared by using the toner comprising the acrylic resin, it was found that the image density was higher than 1.5 in each copy.

The electrostatic capacitances and dielectric constants of the magnetic toners of the present invention comprising the vinyltoluene/acrylic copolymer, the styrene resin and the acrylic resin were 7.3–7.5 PF and 3.74–3.85, 7.3 PF and 3.74, and 7.4 PF and 3.79, respectively. On the other hand, the electrostatic capacitances and dielectric constants of the magnetic toners comprising the polyester resin and epoxy resin were 8.3 PF and 4.26 and 8.2 PF and 4.21, respectively. In each magnetic toner, the volume resistivity was higher than $1.5\times10^{14}$ Ω-cm.

TABLE 6

| Amount (%) of Negative Charge Controlling Agent | Image Density | Fog Density (background) | Sharpness (image quality) |
|---|---|---|---|
| 0 | 1.00 | 0.11 | ○ |
| 1.2 | 1.53 | 0.11 | ◎ |
| 2.4 | 1.53 | 0.11 | ◎ |
| 3.6 | 1.50 | 0.12 | ◎ |
| 4.8 | 1.48 | 0.12 | ◎ |
| 6.0 | 1.45 | 0.13 | ○ |

EXAMPLE 5

In the recipe of Example 4 where the negative charge controlling agent was added in an amount of 1.2% based on the binder resin, the total amount of the binder resin and hydrocarbon wax (low-molecular-weight polypropylene) was changed in the range of from 60% to 120% based on the magnetite, and a magnetic toner was prepared and tested. It was found that if the total amount was smaller than 65%, the image density was reduced below 1.25, and that if the total amount was 120% or more, the fog density was higher than 0.13 with reduction of the sharpness and the toner could not practically be used. Thus, it was confirmed that the total amount was preferably in the range of from 65% (electrostatic capacitance=8.3 PF, dielectric constant=4.26) to 105% (electrostatic capacitance=6.9 PF, dielectric constant=3.54).

What we claim is:

1. In an electrostatic photographic reproduction process which includes the steps of forming a positively charged latent image on a photosensitive plate having a p-type photoconductive layer on an electrically conductive substrate, contacting a magnetic brush of a dry one-component magnetic developer with the surface of the plate carrying the latent image thereon to form a visable image of the developer, contacting the developer image with a transfer sheet and applying corona discharge with the same polarity as that of the electrostatic latent image to transfer the developer image onto the transfer sheet, and fixing the transferred image on the transfer sheet, the improvement comprising using as said magnetic brush a dry one-component magnetic developer which comprises a finely divided magnetic material dispersed in a medium, said medium consisting essentially of (A) a vinyl aromatic polymer or acrylic polymer in an amount of 45 to 95% by weight based on the magnetic material, (B) an aliphatic carboxylic acid or metal salt thereof having a total carbon number (inclusive of the carbon atom of the carboxyl group) of at least 14 per carboxyl group in an amount of 0.2 to 4% by weight based on said magnetic material and (C) a negative charge controlling agent consisting of an alcohol-soluble complex salt azo dye containing chromium, iron or cobalt in an amount of 0.5 to 5% by weight based on said polymer, said magnetic material being triiron tetroxide having a bulk density of at least 0.42 g/ml, a number average maximum size of at least 0.35 μm as measured by an electron microscope and a maximum size/minimum size ratio of 1.0 to 5.5.

2. The electrostatic photographic reproduction process as set forth in claim 1, wherein the carboxylic acid or its salt is a fatty acid having 14 to 32 carbon atoms (inclusive of the carbon atom of the carboxyl group) per carboxyl group or its metal soap, which has a melting point of 20° to 200° C.

3. The electrostatic photographic reproduction process of claim 1, wherein said maximum size/minimum size ratio is from 1.0 to 3.

4. The electrostatic photographic reproduction process of claim 1, wherein said one-component developer has an electrostatic capacitance of 6.5 to 8.5 PF (picofarads) and a dielectric constant of 3.33 to 4.36, said electrostatic capacitance and dielectric constant each being determined under conditions of an electrode spacing of 0.65 mm, an electrode sectional area of 1.43 $cm^2$ and an inter-electrode load of 105 $g/cm^2$.

* * * * *